US005309989A

United States Patent [19]

Grimsley

[11] Patent Number: 5,309,989

[45] Date of Patent: May 10, 1994

[54] OIL WELL FIRE EXTINGUISHING APPARATUS

[76] Inventor: Goodman Grimsley, c/o William S. Britt, Esq., Britt & Britt, P.O. Box 1525, Lumberton, N.C. 28359-1525

[21] Appl. No.: 962,778

[22] Filed: Oct. 19, 1992

[51] Int. Cl.[5] ..... E21B 33/00

[52] U.S. Cl. ..... 166/76; 166/55; 166/85

[58] Field of Search ..... 166/76, 55, 84–87, 166/97, 297, 387

[56] References Cited

U.S. PATENT DOCUMENTS

| | | | |
|---|---|---|---|
| 3,693,715 | 9/1972 | Brown | 166/55 |
| 3,789,689 | 2/1974 | Mace | 166/55 X |
| 5,121,797 | 6/1992 | DeCuir, Sr. | 166/85 X |
| 5,133,405 | 7/1992 | Elliston | 166/85 X |

*Primary Examiner*—Thuy M. Bui
*Attorney, Agent, or Firm*—Richard W. Evans

[57] ABSTRACT

An apparatus for controlling well fires which has a controllable extension pipe, a clamping base and a sealing assembly. The sealing assembly includes a moveable sealing sleeve located between an outer and an inner nesting pipe and plastically deformable sealing material located at one end of the nesting pipes. The sealing assembly is attached to a clamping base. The clamping base can be of two different constructions, a top mount base which, along with the attached sealing assembly, is lowered over the well pipe and a side mount base which clamps from the side with the assembly rotated away from the well pipe. All apparatus controls and method steps can be remotely accomplished.

The top mount base is clamped to the pipe after lowering the apparatus over the well pipe to the point where the well pipe passes through the clamping base and into the interior of the inner nesting pipe. The side mount base is clamped to the well pipe from the side, then the sealing assembly is rotated above the well pipe and lowered to the point where the well pipe is inserted into the inner nesting pipe. The sealing sleeve then forces the sealing material against the well pipe and the inner nesting pipe. The extension pipe is then controlled by actuating a controlling valve, capping the well and extinguishing the fire. The side mount clamping base can be removed from the controlled well for reuse after a clamping jacket is clamped to the exterior nesting pipe and the well pipe.

24 Claims, 6 Drawing Sheets

OIL WELL FIRE EXTINGUISHING APPARATUS

BACKGROUND OF THE INVENTION

1. Field of the Invention

This invention relates generally to the capping of gushing wells whether or not such wells are on fire, fire extinguishing and flow control apparatus and method particularly adapted for use in capping wells whose products are both gushing and on fire, and controlling the flow from such wells.

2. Description of the Prior Art

A variety of oil well fire extinguishing apparatus have been employed in the art. Several major variations differentiate the apparatus taught by the prior art.

Cones or domes or other inverted containers of various sorts have been suggested as housings to be placed over uncontrolled wellheads to stop both the flow and combustion of escaping oil. The apparatus include those designed to contain the flow from one on-shore well (Howe U.S. Pat. No. 1,830,061; Featherstone U.S. Pat. No. 1,520,288), and similar designs with valves to control the flow of oil once the protective hood is in place above the broken wellhead (Sievern U.S. Pat. No. 1,859,606; Teed U.S. Pat. No. 1,807,498). Similar apparatus have been suggested to contain the flow of escaping oil from offshore wells at the ocean floor (Lunde U.S. Pat. No. 4,318,442).

Other designs seek to enclose entire on-shore oil tanks or wells in order to smother flames and contain uncontrolled oil flow (Cunningham U.S. Pat. No. 4,433,733), or offshore platforms (Chiasson U.S. Pat. No. 3,815,682; Roy U.S. Pat. No. 3,730,278; Chiasson U.S. Pat. No. 3,724,555).

Some of the above mentioned patents are designed only for extinguishing fires and do not provide for the control of the well product after the flames are extinguished. While these devices may be effective when the well contents are not under substantial positive pressure, they do not provide a complete solution for the control of fires on pressurized well heads.

The primary problem with cone or dome designs employed to extinguish fires and control the flow of a pressurized well head is that of preventing the escape of well product around the base of the cone or dome. Some designs rely on the weight of the cone or dome and the firmness of the ground around the well pipe to accomplish this sealing. E.g., Sievern, U.S. Pat. No. 1,859,606 (also employing hooks on the sides of the dome from which could be mounted guy wire anchors for further sealing of the cone against the ground). Others employ the pumping of cement or other adhesive into the dome to obtain a good seal after such adhesive hardens. Teed, U.S. Pat. No. 1,807,498. Still others require that the well head already be mounted in a slab contoured to fit tightly within the dome or cone. Howe, U.S. Pat. No. 1,830,061. Still others require some surface preparation, such as construction of a dike around the well, at the time of employment of the fire extinguishing and capping apparatus. Murphy, U.S. Pat. No. 1,857,788.

None of these devices solves the problem of adequately controlling the flow of pressurized well product. The prior preparation of the ground to receive an extinguishing cone prior to a blowout or other problem is expensive. Furthermore, domes heavy enough to effectively stem the flow of product in highly pressurized wells are unwieldy and expensive to use, especially in remote locations. Evidence of these and other drawbacks to such designs is the lack of use of such designs in fighting well fires despite the fact that they have been known in the art for many years.

Some apparatus seek to divert flames and flow of oil by means of a length of pipe placed around, into, or over the broken wellhead (Nicolesco French Pat. No. 1,219,418; Patton U.S. Pat. No. 2,082,216; Wapanob U.S.S.R. Pat. No. 955,945; U.S.S.R. Pat. No. 903.561; Fleischmann U.S. Pat. No. 1,921,739; Collins U.S. Pat. No. 1,938,009). Such apparatus have a flaw analogous to that described above for domes and cones. Most of these diversion apparatus fail to solve the problem of obtaining an adequate seal between the diversion pipe and the well pipe. Thus, they also fail to control the flow of product from pressurized well heads. Neither the Collins device nor the Fleischmann device adequately address the problem of escaping, pressurized well product.

Two devices to deal with sealing the device to the well pipe in a manner which might create a sufficient seal to prevent the undesired escape of pressurized well product. The Teed patent, and the Patton patent. Teed and Patton are discussed in more detail below.

Although apparatus which fail to obtain complete diversion and prevent the escape of pressurized well product may reduce the flames to the point where the fire can be controlled and the well capped by other means, they do not leave the well in a state where production can be quickly and economically resumed. Therefore they provide at most an incomplete solution to the problem.

The Teed patent, U.S. Pat. No. 1,807,498, discloses an extension/diversion pipe connected to a double-walled containment cone or dome and thus, the device would be a hybrid in the classification scheme presented above. The Teed device purports to solve the problem of well product escaping around the base of the cone by pumping an adhesive into the cone in an attempt to cement the cone base firmly to the well pipe.

It employs a product diversion means similar to those in the current invention; however, the adhesive sealing means it employs is very different from the current invention. The device is essentially comprised of a wider and a narrower concentrically disposed cones both attached to one end of a pipe the other end of which is attached to a coupling to which is attached a controlled, vertical "flame pipe" which acts as an extension tube to remove the flaming product from the end of the well pipe to the end of the flame tube, and at least one controlled, horizontal "lead off pipe." The double cone construct is also fitted with two feed tubes, one extending through the inner cone and opening into the interior cone chamber, the other extending only through the outer cone and opening into the outer cone chamber. It appears from the disclosure that the device is to be lowered over the gushing or flaming wellhead with the valve to the flame pipe opened thereby diverting the flame or flow vertically away from the wellhead. Cement or some other adhesive is to be pumped into the inner and outer cone chambers below the wellhead sealing off the flow from the bottom and further forcing the flow upward through the flame pipe. Once the cement has set, the flame pipe valve can be closed and the device capped. Well product can then be diverted into a lead off pipe by opening a lead off pipe valve. The controls on the flame pipe and the lead off pipe are valves which are attached to pulley actuators which are capable of being remotely actuated by pulley belts.

Like the current invention, the Teed patent teaches the use of a controlled extension tube or pipe attached to an apparatus which is fitted over and attached to an uncontrolled, possibly flaming well. Any fire is extinguished primarily by controlling the flow of product with the flame pipe valve. Furthermore, like the current invention, the Teed patent teaches the use of remotely actuated valves. The Teed patent suggests use of pulleys and belts of sufficient length to allow actuation of the valves from a safe distance, while the current invention suggests use of more fire resistant sprockets and chains of sufficient length to allow for safe, remote operation.

The principal differences between the current invention and the Teed apparatus relate to the method of fixing the apparatus to the well pipe. While I do not know whether the Teed method of fixing the device to the well head by use of the cone and pumping in a cement type sealing adhesive has been successful, I believe that the device taught by the Teed patent has not been commercially successful. I believe that the major drawback of the Teed device is the failure of its mechanism for finding the apparatus to the well pipe. In order to work properly the sealing mechanism must be able to complete the seal around the base of the wellhead despite the pressure from the flowing wellhead. It is my belief that the pressure from the gushing well prevents successful sealing by the use of concrete or other adhesive pumped into the Teed double cone construction. Such pressure, even if primarily diverted up through the flame pipe, would still be sufficient to force the wet cement or other adhesive out the bottom of the cone. Furthermore, the Teed device has no mechanism which would force the device into the ground surrounding the wellhead with sufficient force to overcome the wellhead pressure. It must depend on its weight alone to withstand that portion of the wellhead pressure which is not diverted up the flame pipe. Furthermore, even if the inverted dome were forced into the ground around the wellhead, the sealing cone would only be effective where the ground surrounding the wellhead was sufficiently level and firm to prevent the escape of wet cement and well product. Furthermore, in order to work, the Teed device requires the availability of an adhesive, such as concrete, which will remain in its viscous, semisolid state while being pumped into the cone chambers, despite the heat generated by the fire, and then harden. Although a successful diversion of the well flow away from the wellhead up the flame pipe would reduce the flame and heat at the wellhead, the diversion would not be successful until the cones were fully sealed. Therefore, at the time of the introduction of sealing adhesive, there is likely to be significant flame and heat at the wellhead. Finally, even if the device works under real life conditions, the amount of equipment and materials required to operate the device makes it less useful in remote or hostile environments. Wet cement might freeze before use on the Alaskan North Slope. The amount of water needed to mix the cement and the resulting logistical requirements may be a problem in desert conditions. The timing of the mixing of a hardening adhesive, such as cement, might also be a drawback, if the progress of mounting the device could not be accurately predicted. The current invention overcomes all of these drawbacks.

The Patton Device, like the Teed device, employs an extension tube to remove the flame from the well pipe end. The Patton device fixes the extension tube directly to the well pipe by forcing a tapered nozzle into the well pipe and then clamping the nozzle to the well pipe by means of a clamp. The juncture of the nozzle and the well pipe is made leak proof by the introduction of a "liquid sealing material" into the nozzle pipe and through the nozzle pipe into the well head pipe. The extension tube is controlled, fitted with a nozzle with a tapering diameter which is small enough in diameter at the end to fit inside the well head pipe. The suggested method is to position the device over the well head, use a built-in diverting shield to displace the flow of product/flame to the side, force the tapered nozzle into the end of the well pipe and then, once the flame is transferred to the end of the well, clamp the junction of the nozzle and the well pipe together. A liquid sealant is then pumped into the nozzle pipe and forced down into the well pipe where it should seal the junction, forming a permanent seal. The control valve on the flame pipe may then be closed extinguishing the fire.

The drawbacks to the Patton device are several. First, it is difficult to force a pipe of smaller diameter (the nozzle) into a well pipe from which is flowing pressurized and burning well product. Second, it may be difficult to find a sealant which can be pumped into the nozzle, and forced, against the well pressure, down the nozzle and into the junction between the nozzle and the well pipe. Third, the construction of the device does not allow the entire extinguishing job to be accomplished remotely. Workers must bolt the clamp to the junction of the nozzle and the well pipe prior to closing the flame pipe valve.

Despite the wide variety of oil well fire extinguishing apparatus existing in the art to date, as exemplified by the above-discussed designs, there is a continuing need for an improved oil well fire extinguishing and flow control method and apparatus which is easily transported, can be quickly deployed, is structurally and operationally adapted to perform in the hostile environmental conditions, controls the flow of escaping well product, extinguishes combustion quickly, can be remotely operated, and, upon extinguishing the fire and controlling the flow, facilitates prompt resumption of controlled production from the well. However, the prior art does contain adequate solutions for several critical steps in controlling well fires. Means for remotely directing and lowering devices over well pipes are well known. They include use of cranes, booms and positioning cables. Means for remotely activating valves are also well known, including use of chains and sprockets as well as cables or belts and pulleys. Further, remote use of high temperature tolerant hydraulic actuators can be employed to perform many functions involved in the extinguishing of fires, such as the actuation of valves, as well as lowering and raising devices and actuating clamps. Finally, there are many sealing materials which are sufficient to obtain a leak-proof seal around a sealing joint. Various packing and sealing materials are available and are employed by the oil and gas industry which are insoluble in well product, inflammable, temperature tolerant and plastically deformable.

Many well fire extinguishing apparatus simply have not proven themselves in actual service. Current oil well fire extinguishing methods and apparatus actually in use require excessive materials or time before control of the wellhead is achieved and are dangerous to perform or operate. In addition, current oil well fire extinguishing methods and apparatus do not facilitate the simplified resumption of controlled production from the controlled well.

Accordingly, it is a primary object of the present invention to provide, in the manner hereinafter set forth, a method and device whereby a gushing well may be expeditiously extinguished and capped regardless of whether or not the product gushing from the well is on fire.

A further object of the present invention is to provide a method for extinguishing well fires in gushing wells and controlling flow which includes lowering and clamping of a diverting and sealing apparatus to the existing wellhead to divert the gushing well product from the wellhead through the apparatus, sealing the apparatus to the existing wellhead pipe, and closing a valve in the apparatus which controls the flow and extinguishes any product fire by such control.

A further object of the present invention is to provide a device which is simple in construction, inexpensive to manufacture, highly mobile, and capable of being quickly and effectively deployed in hostile environments using a minimum of resources.

It is another object of the present invention to provide an oil well fire extinguishing method and apparatus which allows for the control of the flow of escaping oil and gas and halts combustion quickly while allowing for the safety of the operators and facilitating the timely resumption of controlled production from the well.

It is another object of the present invention to provide an oil well fire extinguishing method and apparatus which greatly reduces the logistical problems inherent in extinguishing oil well fires in remote or hostile environments due to its highly transportable nature and to a reduction in the amount of on-site preparation and material requirements.

It is a still further object of the present invention to provide for a method and device for extinguishing wellhead oil fires and controlling the flow of oil by remote operation.

Other objects and advantages of the present invention will be more fully apparent from the ensuing disclosure and claims.

SUMMARY OF THE INVENTION

The present invention relates to a method for extinguishing oil well fires and for an oil well fire extinguishing apparatus, including novel means and methods of securing the apparatus in position above and surrounding the broken wellhead, scaling the apparatus to the broken wellhead pipe and stopping the uncontrolled flow of oil and gas.

In one aspect, the invention relates to an apparatus for extinguishing oil well fires and capping oil wells, comprising an extension pipe, means for securing the extension pipe to a well pipe, means for sealing the extension tube to the well head, means for controlling the extension pipe, means for directing the extension pipe to a position over the well pipe, and lowering means for lowering the extension pipe over the well pipe. The invention also relates to means for remote operation of the apparatus.

Novel aspects of the invention include the design of the sealing means which employs nesting pipes attached to one end of the extension pipe with sealing material packed into the space between the nesting pipes and the employment of a sealing sleeve also between the interior and exterior nesting pipes to force the sealing material around the junction between the interior nesting pipe and the well pipe and the use of a clamping base to secure the sealing means and the extension pipe to the well head.

One embodiment of the invention employs a clamping base permanently attached to the nesting tubes and containing a cylindrical cavity through which the well pipe can be inserted into the interior of the nesting pipes as the apparatus is lowered over the well pipe. Another embodiment of the invention employs a clamping base pivotally attached to the nesting tubes and containing a well pipe slot into which the well pipe can be placed by horizontal positioning of the clamping base. Once the clamping base is secured to the well pipe by clamping means, the nesting pipes and extension pipe can be rotated into position and lowered over the well pipe end and the sealing means can be activated to seal the well pipe to the extension pipe.

In another aspect, the invention relates to an oil well fire extinguishing method. Depending on the embodiment employed, the method would comprise the steps of positioning an apparatus embodying the invention over a flowing or flaming well pipe, lowering the apparatus exteriorly over the flaming well pipe so the well pipe extends interiorly into the sealing means of the apparatus and the majority of the uncontrolled wellhead products and combustion is diverted through the apparatus and out the top opening of its flame pipe, securing the apparatus to the broken wellhead pipe, sealing the apparatus to the well pipe, and closing the extension tube valve, thereby extinguishing the fire and capping the well; or using the pivotally attached clamping base, the method would comprise the steps of horizontally positioning the clamping base around the well pipe, securing the clamping base to the well pipe, rotationally positioning the nesting pipes and extension pipe above the well pipe, lowering the nesting pipes and extension pipe over the well pipe so that the well pipe extends interiorly into the apparatus, and sealing the apparatus to the well pipe. The invention also relates to the accomplishing the various method steps by remotely operated means.

DETAILED DESCRIPTION OF THE INVENTION, AND PREFERRED EMBODIMENTS THEREOF

The disclosed invention provides a method and means of extinguishing oil well fires. With the foregoing and other objects in view, the invention consists in part of the novel construction, combination and arrangement of parts as hereinafter more particularly described, and as illustrated in the accompanying drawings, but it is to be understood that such drawings and descriptions are to be taken as illustrative of preferred embodiments of the invention and that the invention is not intended to be limited thereby.

Figure 1:
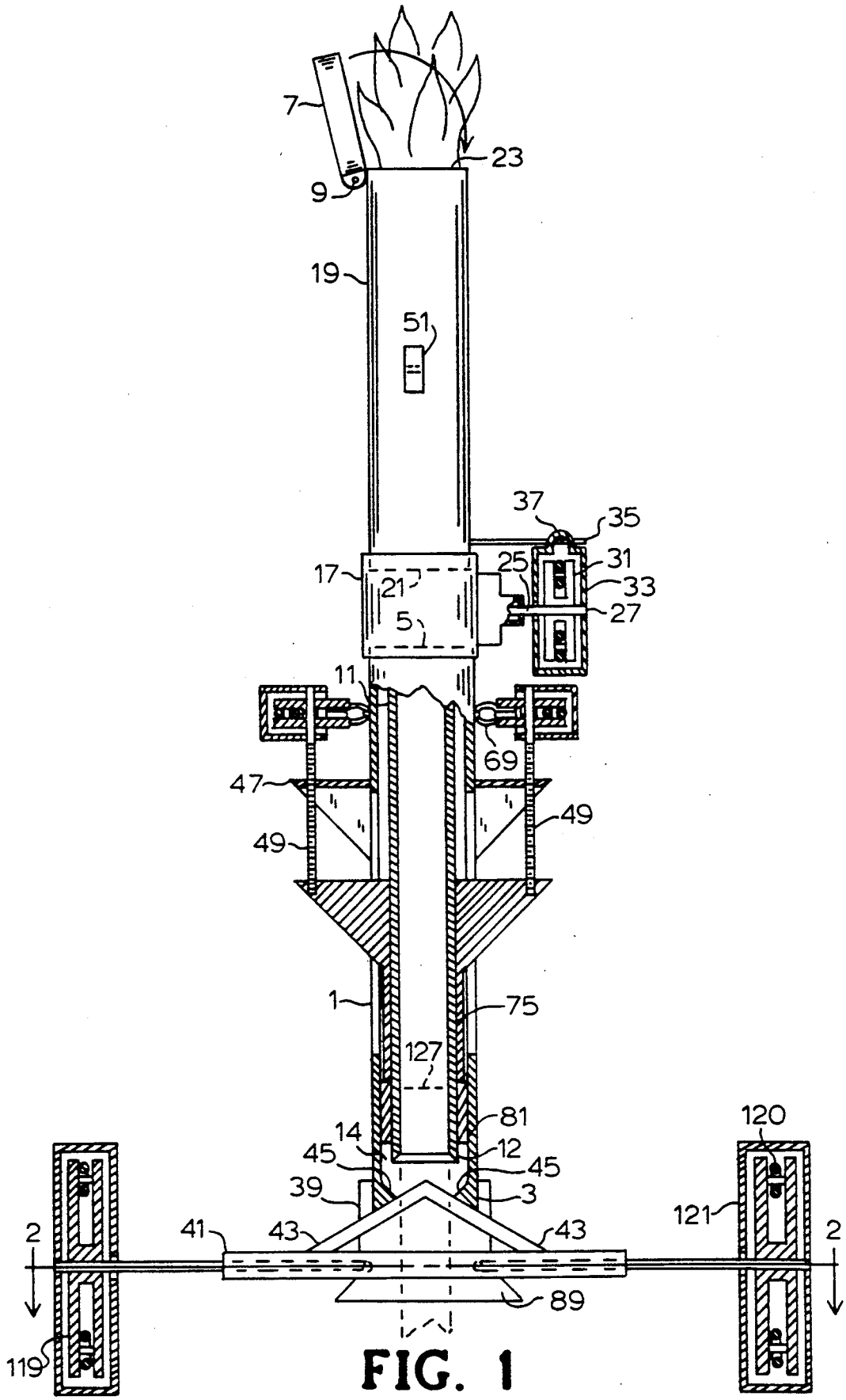
FIG. 1 is a partially sectional front elevation view of a mechanical embodiment of the invention, showing the extension pipe valve, the sealing mechanism, and the clamping base.

Referring now to the drawings, FIG. 1 is a partially schematic front elevation of a preferred totally mechanical embodiment of the oil well fire extinguishing apparatus which is a subject of the invention.

The oil well fire extinguishing apparatus shown in this drawing is comprised of two nesting pipes, an exterior nesting pipe 1 having a first end 3 and second end 5 and an interior nesting pipe 11 having a first end 12 an d which is not illustrated. The second ends of said nesting pipes are fused together and joined to the extension pipe valve 17. Joined to said extension pipe valve oppositely from said nesting pipes is the extension pipe 19 which has a first end 21 and a second end 23 and is joined to the extension pipe valve at its first end, thereby forming an extension pipe/nesting pipes assembly. At the second end of said extension pipe is a spring-loaded or otherwise counterbalanced cap 7 which is attached to the extension pipe by a spring hinge 9 and which is designed to open in response to the force of the well product flowing through the extension pipe but will close and extinguish any residual combustion after closing of the extension pipe valve.

In the embodiment illustrated in FIG. 1, said exterior pipe 1 is attached to a clamping base 41 by permanent insertion of said first end of said exterior pipe into the clamping base collar 39. Said collar and clamping base contain openings which align with the opening in the first end of said exterior nesting pipe and the diameters of said openings are at least as great as the inner diameter of the first end of the exterior nesting pipe. The method of attachment of said inserted second end of said external pipe into said clamping base collar must result in a permanent bonding of these elements and could be by threaded coupling, welding or other suitable manner. The clamping base collar is permanently bonded to the top surface of the clamping base. Clamping base braces 43 provide further structural strength to the attachment of the clamping base to the clamping base collar.

The inserted portion of said first end of said exterior pipe retains the same outer dimensions as the rest of the pipe but is thickened and flared inwardly for a short distance so that, moving along the portion of said exterior pipe which is inserted into said clamping collar from said first end toward said second end, said exterior pipe has a progressively smaller interior diameter so that the interior surface of the thickened first end of said exterior pipe resembles the interior of an inverted cone section or funnel. The inner diameter of said first of said exterior pipe at its smallest is slightly larger than the exterior diameter of said interior pipe and forms a single constriction ridge 45 near the first end of said exterior pipe. The plane of said constriction ridge 45 is perpendicular to the longitudinal axis of said pipe. Proceeding toward said second end of said exterior pipe along said longitudinal axis of said exterior pipe from said constriction ridge and proceeding toward said first end of said exterior pipe along said longitudinal axis of said exterior pipe from said constriction ridge, the interior diameter of said exterior pipe increases until it approaches the normal thickness of the unthickened portion of the exterior pipe wall.

An interior nesting pipe 11 with a first end 12 and with a second end, which second end is fused to the second end of said exterior nesting pipe, is concentrically and interiorly disposed within said external nesting pipe so that both share the same vertical axis. The second end of said interior pipe is welded or fused to the second end of said exterior pipe immediately below said extension pipe valve. Said interior pipe extends concentrically within said exterior pipe from said second end at said valve fitting toward said first end of said exterior pipe where it terminates. Said first end of said interior pipe ends a short distance before reaching said constriction ridge of said exterior pipe, thus forming a sealing gap between the end of said interior pipe and said constriction ridge. Said first end 12 of said interior pipe is not thickened as is said first end of said exterior pipe, but is also inwardly tapered so that the inner surface of said first end of said interior pipe also resembles the interior of an inverted cone section or funnel with the greater interior diameter at the first end and the lesser interior diameter closer to said second end. The taper angle of said first end of said exterior pipe being substantially the same as the taper angle of said first end of said interior pipe. The external diameter of said interior pipe and the internal diameter of said exterior pipe are such that an annular space is created between the two nesting pipes. A sealing sleeve 75 fits snugly but slidingly between said nesting pipes. The internal diameter of said interior pipe is sufficiently larger than the exterior diameter of the well pipe for which the apparatus is designed to allow the well pipe to be inserted into the interior pipe.

The extension pipe valve 17 which is attached to the joined second ends of the nesting pipes is a valve of common design which, in its opened position, provides no obstruction to the flow of well product but, in its closed position, completely obstructs flow through the pipe. Said valve has a valve stem 25 with a first end and a second end 27. Said first end is rotatably attached to the valve gate within the valve housing. Said second end projects outwardly from said valve. Fixably attached to said second end of said valve stem is an actuator 31. In the FIG. 1 embodiment, said actuator is a chain sprocket designed to engage the links of a drive chain. This function can also be performed by suitable substitutes such as a drive belt pulley coupled with a drive belt or a cable pulley and a cable. Partially surrounding said actuator is an actuator housing 33. Said actuator housing is rotatably mounted to the valve stem and the axle of actuator but is held in place by stabilizer rod 35 which is mounted to the extension pipe and which extends through the stabilizer rod guide protrusion 37 of the actuator housing 33. Said stabilizer rod guide slidably engages a housing stabilizer rod 35. Said rod guide and stabilizer rod prevent the chain guard from rotating with the actuator as the actuator is rotated to open or close the extension pipe valve while allowing the chain guard to move closer to or further from the apparatus as the valve is opened and closed. Also mounted to the exterior surface of said extension pipe at suitable locations are as or more lifting eyes 51 (shown in FIG. 5) which are commonly used to allow for the attachment of lifting hooks, guide ropes, guide wires and the like.

Figure 5:
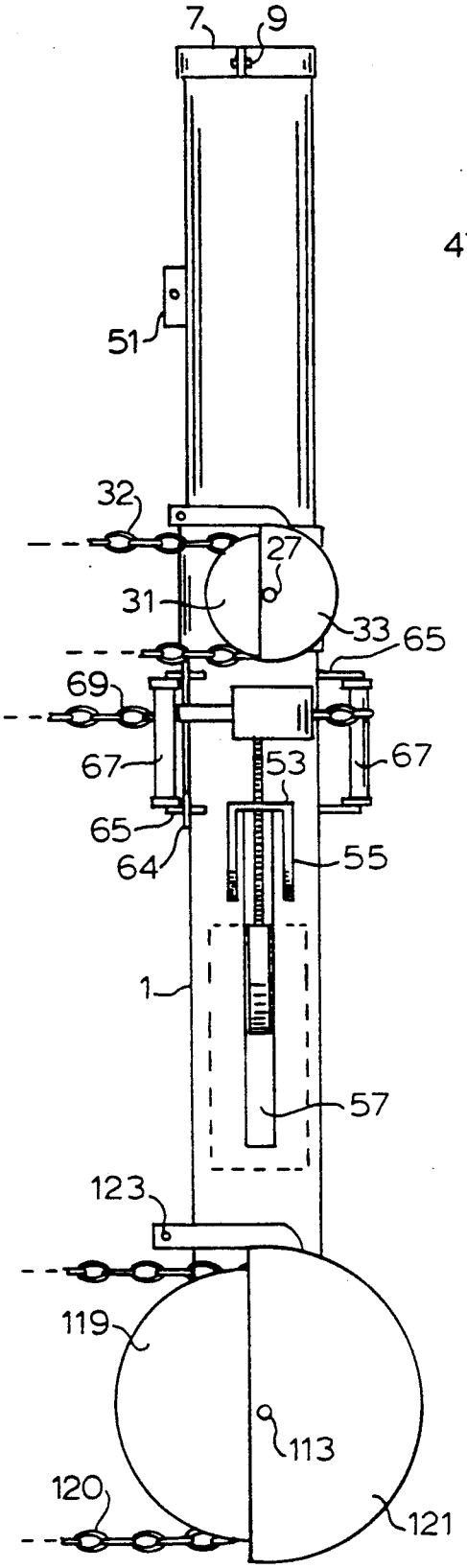
FIG. 5 is a side elevation view of the FIG. 1 apparatus showing the extension pipe valve actuator, a sealing sleeve drive rods and actuators and roller spool brackets and roller spools, and a clamping blade drive rod actuator.
Figure 6:
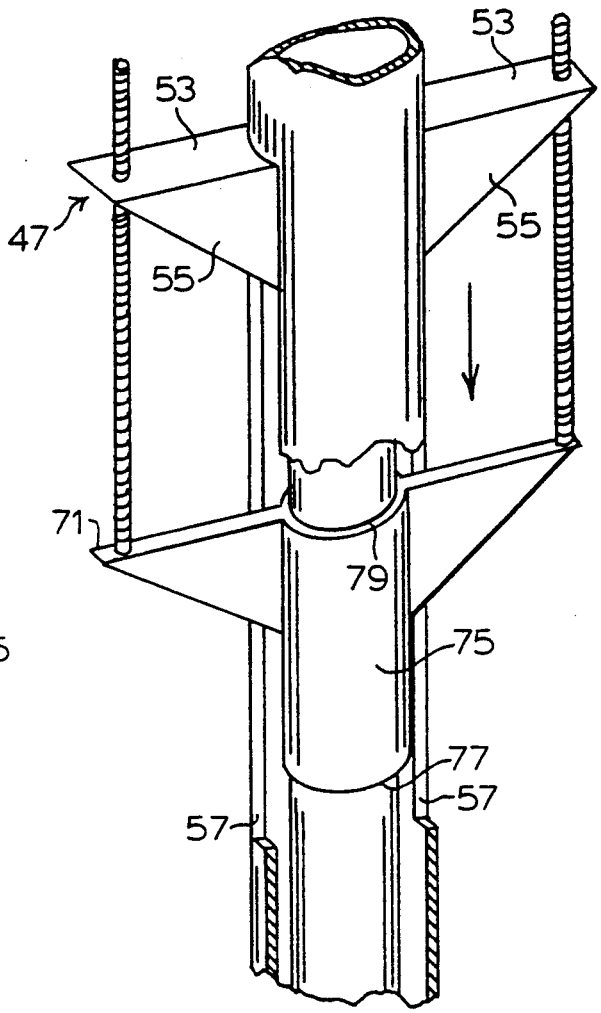
FIG. 6 is a front cutaway view of a portion of the nesting pipes showing the sealing sleeve and the sealing sleeve drive rods and flanges. The sealing sleeve design is the same in the FIG. 1 and the FIG. 9 embodiments.

Mounted below said extension pipe valve are a pair of oppositely and radially extending driving rod supports 47. Said rod supports may be of a variety of shapes and constructions provided that they are attached to said exterior pipe in such a manner as to have sufficient rigidity to provide a rigid support from which can be transmitted the sealing force exerted by the operation of the sealing sleeve drive rods 49. In the embodiment represented in the drawings said rod supports are comprised of a rectangular mounting platform 53 seen best in FIG. 5 and FIG. 6. Said mounting platform contains a vertically oriented threaded bore adapted for engagement with a threaded, sealing sleeve drive rod 49. Said mounting platforms are each braced by two parallel bracing members 55 which, in the illustrated embodiment, are in the shape of right triangles as shown in FIG. 6. The sides of said bracing members adjacent to the right angle of said right triangle are attached respectively to the external surface of said exterior tube and the sides of the mounting platform. Alternatively, the mounting platform and braces can be formed out of a single piece of material such as channel bar. The sides of the mounting platform bracing members 55 which are attached to said exterior pipe are attached to said pipe on either side of a vertically extending sealing sleeve flange guide slot 57 which extends toward the first end of said exterior pipe from a point directly below the point of attachment of the rectangular mounting platform, 53.

Figure 8:
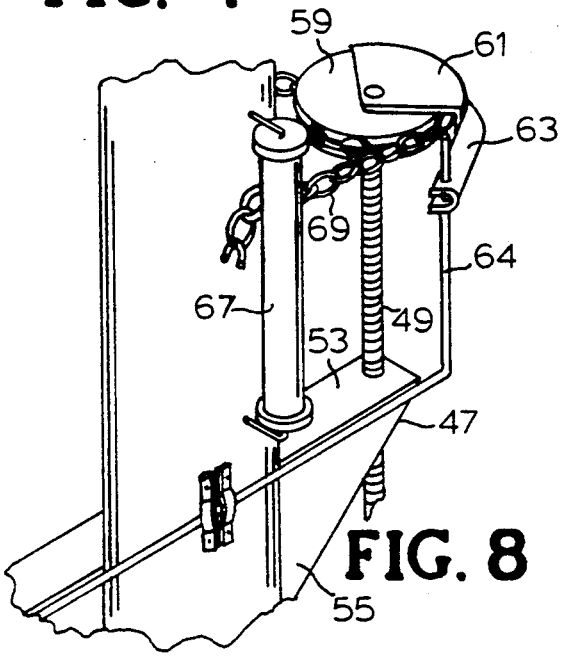
FIG. 8 is a side elevation of the exterior nesting pipe showing a sealing sleeve drive rod actuator, chain housing with stabilizer rod guide, and stabilizer rod. This portion of the apparatus is identical in the FIG. 1 and FIG. 9 embodiments.

Extending through said threaded bores in said mounting platforms are two threaded sealing sleeve drive rods 49 each of which has a first and second end. A sealing sleeve drive rod actuator 59, best shown in FIG. 8, is fixedly attached to the first end of each said sealing sleeve drive rod. Each said actuator is similar in construction to said valve actuator 31 discussed above.

As shown in FIG. 8, each said actuator is partially surrounded by an actuator housing 61 which is rotatably attached to said sealing sleeve drive rod above and below said actuator. Attached to each actuator housing is a stabilizer rod guide 63 which is slidably attached to a drive rod actuator housing stabilizer rod 64. Said stabilizer rod is substantially L shaped and is attached to the surface of said exterior nesting pipe below said drive rod, extending substantially perpendicularly to the longitudinal axis of the nesting pipes and extension pipe then extending substantially parallel to said longitudinal axis toward said second end of said exterior nesting pipe.

Figure 7:
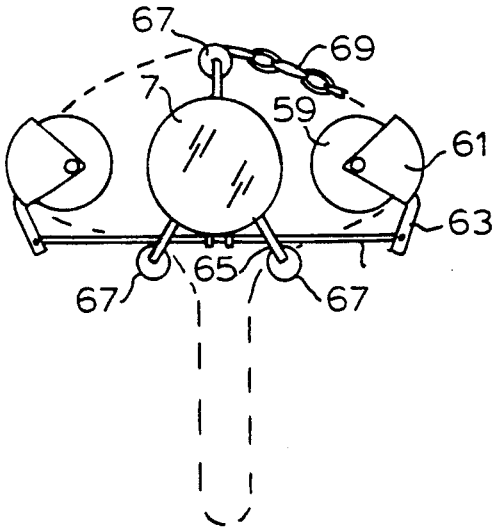
FIG. 7 is a horizontal cross-sectional view of the nesting pipes assembly, showing the sealing sleeve drive rod actuator sprockets, chain, chain guards, chain guides and roller spools. The design of this portion of the invention is the same in the FIG. 1 and FIG. 9 embodiments.

Also attached to the exterior nesting pipe are a plurality of roller spool brackets 65. Rotationally attached to each said bracket is a roller spool 67. Said roller spools are located as illustrated in FIGS. 5 and 7 and are positioned to guide a single sealing sleeve actuator drive chain 69 which engages both sealing sleeve actuators. Driving the actuators with a single drive chain prevents binding of the sealing sleeve during movement and allows for smooth extension and retraction of the sealing sleeve along the vertical axis of the nesting pipe within the annular space between the interior and exterior nesting pipes.

As shown in FIG. 6, each of said second ends of said sealing sleeve drive rods is rotatably attached to one of the two radially extending sealing sleeve flanges 71 of said sealing sleeve 75. Said sealing sleeve flanges protrude radially and oppositely from the exterior surface of said sealing sleeve 75 through said guide slots in said exterior pipe. The body of said sealing sleeve is tubular in shape and fits slidably and concentrically between said interior nesting pipe and said exterior nesting pipe. The tubular body of the sealing sleeve is constructed of pipe with inside diameter greater than the outside diameter of said interior nesting pipe and with an outside diameter less than the inside diameter of said exterior nesting pipe, so that said sealing sleeve substantially occupies the space between said interior pipe and said exterior pipe but is translatable vertically coaxially within said space.

Said sealing sleeve flanges are of a width sufficient to allow attachment of said second ends of said drive rods but thin enough and so positioned on the sealing sleeve so as to protrude through said guide slots 57 in said exterior pipe. When said sealing sleeve drive rods are in the fully retracted position said flanges are close to or in contact with the top end of said guide slots and are directly below and close to said drive rod mounting platforms. As said drive rods are extended said sealing sleeve flanges slide the length of said guide slots as said sealing sleeve is translated toward said first ends of said nesting pipes. The unthreaded bores in said flanges, or other attachment means which attach said drive rods to said flanges, are positioned on said flanges so that they are directly below the threaded bores in said driving rod mounting platforms and are constructed so that translation of the rotating driving rods in either direction along the rod's longitudinal axis results in a corresponding translation of the flanges and the attached sealing sleeve. Said sealing sleeve 75 has a first end 77 which is closer to said first ends of said nesting pipes and a second end 79 which is closest to said fused second ends of said nesting pipes.

As seen in FIG. 1, plastically deformable sealing material 81 is packed in the gap between the first end of said interior nesting pipe and the constriction ridge 45 in said exterior nesting pipe and in the annular space between said nesting pipes for a short distance above said second end of said interior nesting pipe. Such material must be resilient, not flammable, and capable of flowing into said gap when said sealing sleeve is turned against its upper surface. Said sealing material must extend sufficiently above said constriction ridge 45 in said annular space so that a sufficient volume of material is packed in the pipe to completely surround the well head pipe inserted into said interior nesting pipe and form a tight seal. Said sealing material should not be placed in the annular space at a point above the point of termination of said exterior pipe guide slots.

Said first end of said sealing sleeve must extend a sufficient distance below the point of attachment of the sealing sleeve flanges to the body of the sealing sleeve so that, when the sealing sleeve is fully extended, the second end of the sealing sleeve extends sufficiently below the end of the guide slots to force enough sealing material against the constriction ridge and into the space surrounding the well head pipe and the first end of the interior nesting pipe to form a tight seal. The length of said second end of said sealing sleeve above the upper surface of the flange must be short enough so that in its fully retracted position said second end of said sealing sleeve is not in contact with said deformable sealing material 81. In the illustrated embodiments, the first end of the sealing sleeve does not extend beyond the point of attachment of the sealing sleeve flanges. Furthermore, there must be sufficient distance between the lower end of the guide slots and the lower end of the fully extended sealing sleeve so that a sufficient volume of sealing material can be packed in the annular space below the guide slots to form an effective seal and so that the guide slots do not interfere with the effectiveness of the seal.

When said sealing sleeve and driving rods are in the fully retracted position, each said sealing sleeve flange may fit between the two mounting platform bracing members 55 of its corresponding driving rod mounting platform. When said sealing sleeve and driving rods are in the fully extended position, the lower surface of said flange brace may contact the lower end of said guide slot.

In the embodiment of the invention illustrated in FIGS. 1-8, said first end of said exterior nesting pipe is fixedly mounted in the second end of said clamping base collar 39. Said clamping base collar 39 is a cylindrical boss with a horizontal cross-sectional inner diameter roughly equivalent to the outer diameter of said exterior pipe to which it is fixedly attached. The first end of said clamping base collar is fixedly attached to the top plate of the clamping base 41. Attached to the front and back of the collar are clamping base braces 43. The clamping base braces are also attached through the clamping base upper plate to the main clamping base frame 85. This attachment must be accomplished in such a way that the path of the clamping blades 87, seen in FIGS. 2 and 4 will not be obstructed.

Attached on the opposite side of the clamping base from said collar is a flared tubular member 89 seen in FIG. 1 which is attached to the lower plate of the clamping base. The internal diameter of said tubular member is at its smallest at the point of attachment to said lower plate at which point the inner diameter of said tubular member is of a similar dimension as the inner diameter of said clamping base collar.

Figure 2:
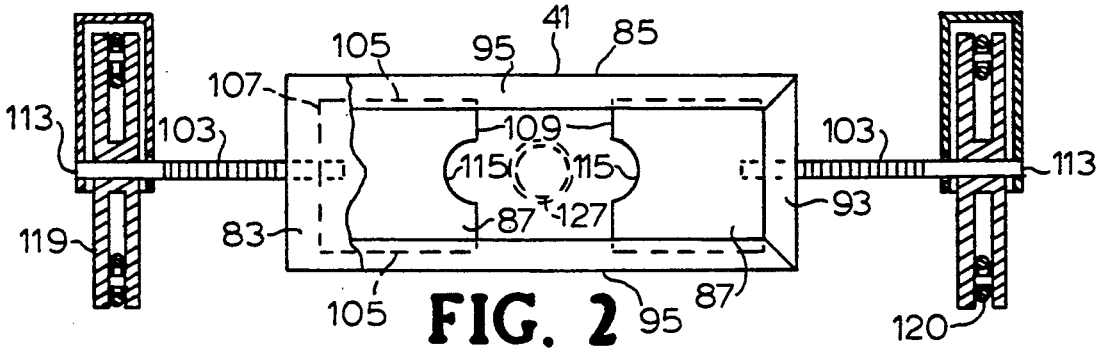
FIG. 2 is a cross section of the FIG. 1 apparatus on line 2—2 of FIG. 1, showing the clamping base with clamping blades in the retracted position.
Figure 3:
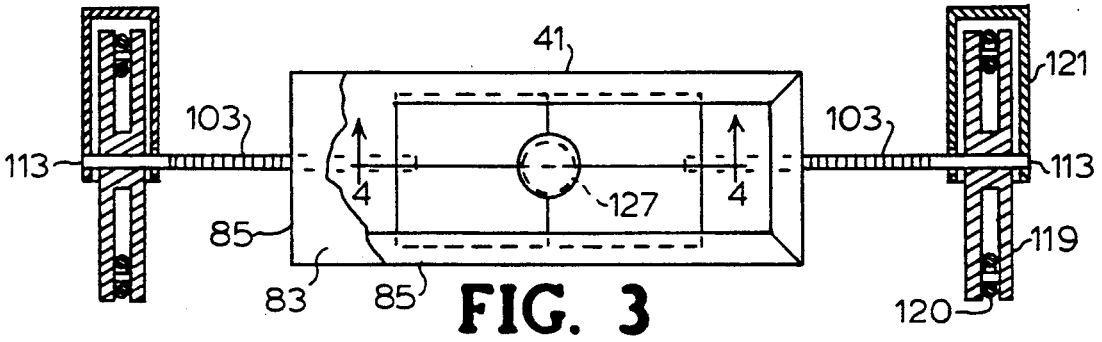
FIG. 3 is a cross section of the FIG. 1 apparatus on line 2—2 of FIG. 1, showing the clamping base with clamping blades in a extended position.

As seen in FIG. 2, the clamping base is framed by four rigid channel bar frame members: two shorter end bars 93 and two longer side bars 95. Said frame members are roughly U shaped in cross section with a first side and a second side which are substantially parallel to each other and which are connected to each other by a substantially perpendicular third side, forming a three-sided bar open on the fourth side. The two side bars are fixedly connected on each end to the ends of the two end bars, forming a substantially rectangular frame with the open side of the channel bar frame members facing inwardly toward the center of the resulting frame, with the outer surfaces of the parallel sides of said frame members form the top and bottom surfaces of the frame, with the top surface of the frame being the surface facing toward the nesting pipes and sealing mechanism of the apparatus. Mounted on the top surface of the frame is the upper clamping base enclosure plate which is preferably made out of sheet metal and designed to cover the entire top surface of the clamping base, except for the central cavity. Mounted to the bottom surface of the frame is the lower clamping base enclosure plate which is preferably made out of sheet metal. The enclosure plates are fixedly attached to the clamping base frame by welding, bolting, riveting or other such mounting means. The upper and lower enclosure plates contain circular openings, the diameters of which correspond to the inner diameter of the clamping base collar. Said circular openings are positioned so that their centers correspond to the longitudinal axis of the apparatus.

The outer surfaces of the perpendicular connecting sides of the frame members form the exterior side edges of the clamping base. The facing interior surfaces of said side bars act as parallel clamping blade guides extending the length of the base. The end bars 93 each contain a single centered, threaded bore which thread engages the external threads of the clamping blade drive rods 103. Disposed within the interior of the clamping base are two clamping blades 87 with parallel, outer guiding edges 105 resting slidably with the clamping blade guides which are formed of or fixed to the upper and lower interior surfaces of the side bars of the clamping base frame. In the illustrated embodiment the clamping blade guides are merely the interior parallel surfaces of the side bars. However, should it be desired, polished clamping blade guide runners could be fixedly mounted to the inner surfaces of the parallel sides of the side bar frame members.

Each said clamping blade is in shape a thickened rectangular solid with a first and second shorter ends and with two longer sides. The longer sides communicate with the interior surfaces of the side bars of the clamping base frame which interior surfaces act as clamping blade guide surfaces. When the clamping blades are disposed within the clamping base frame, said longer sides extend slidably between the inside parallel surfaces of said clamping base guides. Said shorter ends of said clamping blades are oriented generally parallel to said end bars of said clamping frame. Said shorter ends 107 of said clamping blades 87 are rotatably attached to said first ends 111 of said clamping blade drive rods 103. The second end 109 of each clamping blade contains an arcuate indentation the focus of which is the center point of said edge. The surface of said indentation is the clamping face 115. The radius of said indentation is slightly less than one half the external diameter of the wellhead pipe on which the apparatus is intended to be used so that said face is adapted to clamp halfway around the circumference of the wellhead pipe. The clamping face contains a multiplicity of arcuate clamping ridges 117 disposed parallel to each other and to the plane of the blade which plane is perpendicular to the longitudinal axis of the nesting pipes.

The clamping blades are thick enough to provide sufficient clamping surface to hold the wellhead pipe firmly, but thin enough to fit slidably between the inside parallel surfaces of the clamping base guides. The width of said clamping blade is slightly less than the width of said clamping base. Said clamping base contains at least one clamping blade. The illustrated embodiment contains two clamping blades disposed oppositely so that the clamping faces of the clamping blades face each other. When said clamping blades are fully extended, said second ends of said clamping blades meet and said clamping faces forming a cylindrical clamping surface whose longitudinal axis coincides with the longitudinal axis of the nesting pipes and intersects the center points of said clamping base collar and said flared tubular member.

Each of the clamping blade drive rods 103 is threaded and has a first end 111 and a second end 113. Fixedly attached to the second end 113 of each threaded clamping blade drive rod 103 is a drive rod actuator 119, similar in construction and function to the sealing sleeve drive rod actuators 59 previously discussed. Each clamping blade drive rod actuator is partially surrounded by an actuator housing 121 seen in FIG. 3. Each actuator housing has an extension attached which contains a circular cutout and which functions as a stabilizer rod guide 123 seen in FIG. 5. The stabilizer rod is not illustrated but is attached to the exterior nesting pipe near the first end of said nesting pipe in similar fashion to that of the sealing sleeve stabilizer rod illustrated in FIG. 8. The actuator housing stabilizer rod is inserted through said circular cutout in said rod guide and is thereby slidably connected to said rod guide. The rod and rod guide function similarly to the extension pipe valve housing stabilizer rod 35 and rod guide 37, seen in FIG. 1, and to the sealing sleeve stabilizer rod and rod guide 63 and stabilizer 64 previously discussed.

The first end 111 of each said clamping blade drive rod 103 seen in FIG. 2, is rotatably attached to the shorter end 107 of a clamping blade in a manner similar to that in which the sealing sleeve drive rod 49 is attached to the sealing sleeve flange 71. Coordinated operation of drive rod actuators 119 causes rotation of the threaded drive rods which by such rotation are translated in relation to the clamping base end bars. Such translation also causes translation of the clamping blades attached to each drive rod along the clamping blade guides. Depending on the direction of rotation, the clamping blades are either retracted or extended. In fully retracted position, the clamping blades do not interfere with the passage of the well pipe through the clamping base. The device is placed over the well pipe with clamping blades in the retracted position. When fully extended after the device is placed over the well pipe, the clamping blades meet each other urging the clamping surfaces tightly against the well pipe.

Figure 4:
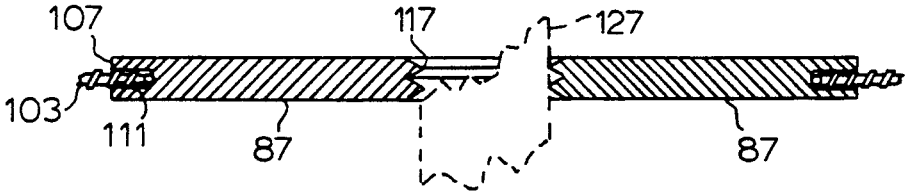
FIG. 4 is a front cutaway view of the clamping mechanism of the FIG. 1 apparatus as shown on line 4—4 of FIG. 3, showing the ridged gripping surfaces of the clamp in extended position.

The FIG. 1 apparatus is used by positioning the apparatus above the flowing/flaming well pipe, lowering the apparatus over the broken well pipe 127 seen in FIG. 4 by suitable positioning and lowering means, such as by use of a crane and a multiplicity of guide cables which are attached to various lifting eyes 51 mounted on the apparatus. Prior to lowering the apparatus over a burning well pipe the clamping blades are placed in the fully retracted position and the extension pipe valve 17 in the open position. This allows the well pipe to extend through the clamping base and the well product to pass of through the interior opening in the nesting pipes and out the second end 23 of the extension pipe 19.

To secure the apparatus to the well pipe, to seal the apparatus to the well pipe and to control the flow of well product at a broken well pipe, the apparatus is lowered over the well pipe so that the well pipe end 127 is inserted interiorly into the lowermost portions of the apparatus. During the lowering of the apparatus and the insertion of the wellhead into the apparatus, the flared tubular member 89 acts as a guide to assist in directing the pipe through the openings in the lower and upper plates of the clamping base. Once the wellhead pipe is inserted into the flared tubular member 89, the majority of the well product will proceed upward through the apparatus and exit the apparatus at the second end of the extension pipe. If the well product is on fire, the location of substantially all of the combustion will shift from the end of the wellhead pipe to the second end of the extension pipe, where the product exits the apparatus. The product pressure will push open the spring-loaded or counterbalanced extension pipe cap 7.

As the apparatus is lowered further, the end of the wellhead pipe passes upwardly between the retracted clamping plates 87, through the clamping base collar 39, through the first end 3 of the exterior nesting pipe, past the constriction ridge 45 and through the first end 12 of the interior nesting pipe. For the most effective seal to be obtained, the well pipe must pass beyond the constriction ridge 45 in the exterior nesting pipe and, at least a short distance into the interior nesting pipe. To assure the feasibility of passage of the well pipe to the desired position, the inner diameter of the interior nesting pipe of the apparatus is designed to be at least slightly greater than the outer diameter of the well pipe.

Once the apparatus is lowered over the well to a point where the well pipe extends sufficiently into the apparatus for an effective seal to be formed, the clamping blade drive rod actuators are rotated by chains extending the clamping faces of the clamping blades toward each other and toward the well pipe. The actuators are rotated in unison by use of actuator chains so that the movement of the clamping blades is coordinated until the clamping faces of the two blades contact the well pipe and are urged against said pipe with sufficient force to lock the apparatus to the pipe, thus stabilizing and supporting the apparatus without assistance from the crane or guidance ropes.

After the apparatus is firmly attached to the broken well pipe by the urging of the oppositely disposed clamping faces against the well pipe, the sealing sleeve driving rod actuators are rotated in a coordinated manner by use of an actuator chain causing the downward translation of the sealing sleeve. As the sealing sleeve is translated downward, the second end of the sealing sleeve contacts the deformable packed sealing material 81 forcing it downward toward the constriction ridge in the exterior pipe and inward toward the well pipe as well as forcing the sealant against the inner surface of the exterior pipe and the outer surface of the interior pipe. The sealing sleeve drive rod actuators are rotated until the sealing material is compressed against these surfaces with sufficient force to prevent the passage of any well product, except up through the interior pipe cavity.

Once the sealing sleeve is fully extended the sealing process is complete and well product cannot exit the combined well pipe/apparatus except through the second end of the extension pipe. At this point the extension pipe valve actuator is rotated by the valve actuator chain until the extension pipe valve is frilly closed. As the extension pipe valve 17 is closed, the flow of well product through the second end 23 of the extension pipe 19 is stopped, depriving the fire of its fuel. Any vestigial flames will be extinguished by the extension pipe cap which will return to its closed position closing off the air supply to any well product remaining in the extension pipe above the closed valve.

At this point, the apparatus has stopped both the flow and combustion of product, and, by attachment of suitable piping to the apparatus, productive recovery of well product may be continued in a timely manner. The apparatus can easily be modified to include a "T" fitting to which a valve and a lead off pipe could be attached in similar fashion to that shown in the Teed patent or a suitable lead off pipe can be installed in place of the extension pipe. The apparatus can be permanently attached to the well pipe by welding the clamping blade drive rods 103 to the clamping base end bars 93 at the threaded bores centered in each end bar. Similarly, the sealing sleeve position can be permanently fixed by welding the sealing sleeve drive rods 49 to the drive rod mounting platform 53.

Where the cross-sectional profile of the well pipe has been distorted by the events leading to the damage to the well pipe, the well pipe might not be insertable all the way into the device. In such a circumstance the clamping blades can be extended when the well pipe end is in the clamping base to restore the cross sectional profile of the well pipe end to a circular shape by urging the blade faces against the distorted portion of the well pipe end. The blades can then be retracted and the wellhead pipe further inserted into the apparatus.

Remote actuation can be accomplished by using extended lengths of chain to actuate the clamping blade actuators, the sealing sleeve drive rod actuators and the extension pipe valve. Remote motorized chain drives or other actuating means are old in the art as are positioning and lowering means and such are not separately claimed.

The construction of the clamping base differs according to the embodiment of the invention. There are two embodiments illustrated: a mechanical embodiment illustrated in FIGS. 1–8 and a partially hydraulic embodiment illustrated in FIGS. 9–14. The two illustrated embodiments are merely illustrative examples and are not the only possible embodiments encompassed by the invention, neither are they mutually exclusive. Certain design elements contained in the partially hydraulic embodiment could be adapted for use in a purely mechanical embodiment and certain design elements contained in the purely mechanical embodiment could be adapted for use in a partially hydraulic embodiment.

Figure 9:
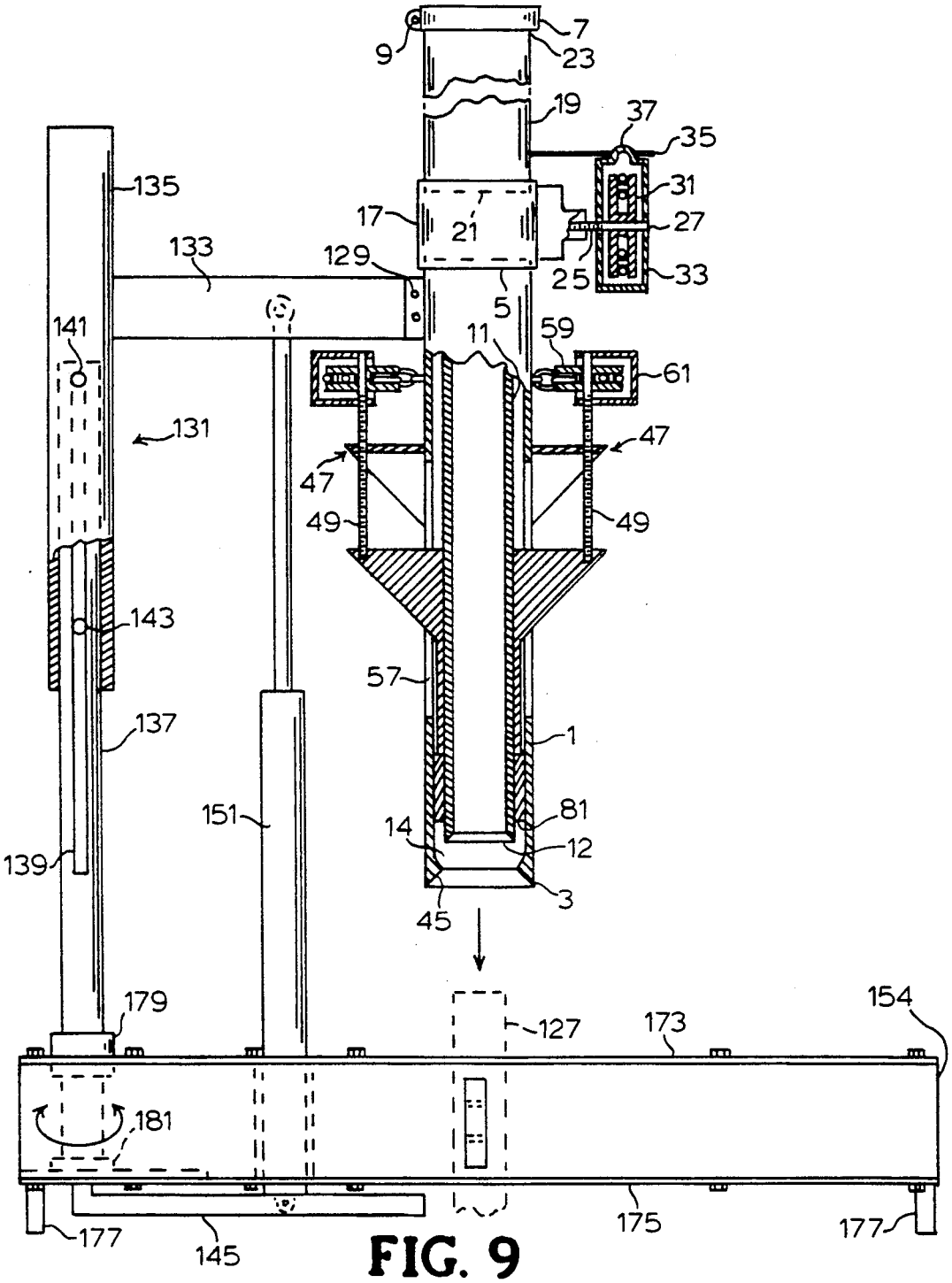
FIG. 9 is an partially cut away elevation view of a partially hydraulic embodiment of the invention with pivotally connected, hydraulically actuated lowering and clamping mechanisms. The first end of the exterior nesting pipe is not attached to the clamping base as in the FIG. 1 apparatus. Rather, the extension pipe/nesting pipes assembly is attached to the clamping base through a swing arm attached to a pivot pole.

FIG. 9 illustrates a partially hydraulic embodiment of the invention. In the partially hydraulic embodiment, the main body of the apparatus, including the extension pipe, nesting pipes and sealing sleeve, together with the various actuators, remains unchanged from the extension pipe 3 cap, 7, to the first end 3 of the exterior nesting pipe 3, except for the replacement of the lifting eyes, 51, with a swing arm mounting bracket 129. This part of the apparatus is sometimes referred to as the extension pipe/nesting pipes assembly.

However, unlike the purely mechanical embodiment illustrated in FIGS. 1–8 and previously discussed, in the partially hydraulic embodiment the manner of attachment of the extension pipe/nesting pipes assembly to the clamping base is different and the clamping base is of a different design. The frame of the mechanical clamping base, illustrated in FIGS. 1–4, may be constructed of narrower channel bar in that the mechanical base houses only clamping blades. The thickness of the mechanical base is dependent only on the thickness of the clamping blades which, in turn, depends on the required surface area of the clamping faces. In contrast, the hydraulic clamping base contains not only clamps (in the embodiment shown two arcuate, hinged clamping jaws) but also a mounting point for a pivot pole 131 and three hydraulic cylinders 149 and 163 (see FIGS. 9, 10, 11). Thus, the illustrated hydraulic clamping base 154 is thicker than the illustrated mechanical clamping base.

While both clamping bases are preferably enclosed by use of top and bottom sheet metal plates, the mechanical base has a cylindrical cavity passing through the top and bottom plates and a flared tubular member (FIG. 1 no. 89) attached to the bottom plate to guide the top of the well pipe into said cavity. In contrast, the hydraulic base has a second slot 171 through which the well pipe can be inserted from the side, rather than the top of the base. Consistent with this design, in the hydraulic embodiment the exterior nesting pipe is not directly attached to the clamping base over the well pipe insertion and clamping area, but swings free (compare FIG. 1 to FIGS. 9 and 12). In place of a clamping base collar (FIG. 1 No.39) there is a swing arm/pivot pole assembly which pivotally attaches the extension pipe/nesting pipes assembly to the clamping base. The mechanical embodiment is designed to be placed above the well pipe and then lowered over the well pipe. This method of use creates some difficulty in that the pressure of the flowing well must be overcome while the flow is being diverted through the extension pipe/nesting pipes assembly. In contrast, the hydraulic design allows the well pipe to be approached from the side, and the clamping base to be firmly clamped to the well pipe before the extension pipe/nesting pipes assembly is rotated into position over the well pipe (See FIG. 12).

While in the mechanical embodiment the first end of the exterior extension pipe is fixedly attached to the clamping base directly over the point of entry of the well pipe by means of a clamping base collar, the "tension pipe/nesting pipes assembly swings away from the well pipe clamping region in the hydraulic embodiment. This allows the apparatus to be clamped to the well pipe without need to overcome the well pipe product pressure and allows precise positioning and lowering of the extension pipe/nesting pipes assembly by use of hydraulically assisted positioning means more fully discussed below.

As seen in FIG. 9, the extension pipe/nesting pipes assembly is attached to the outer tube 135 of a telescoping pivot pole 131 by means of a swing arm 133 which is bolted to the swing arm mounting bracket 129, which bracket is permanently attached to the exterior nesting tube of the main body of the sealing apparatus. The swing arm 133 is fixedly attached to said outer tube 135. Said telescoping pivot pole contains an inner tube 137 and an outer tube 135. Said inner tube, if hollow, contains two guide slots 139 which extend vertically within the inner tube and are disposed oppositely. If said inner tube is a solid rod, a single longitudinal slot serves the same function. The outer tube 137 contains two guide pins, an upper guide pin 141 and a lower guide pin 143, which guide pins are perpendicular to and extend through the longitudinal axis of the outer tube, are parallel to each other, are within the same longitudinal plane, and are designed to fit within the inner tube guide slot. The guide pins fit within the guide slot of the inner tube and thus prevent the rotation of the outer tube relative to the inner tube around their shared longitudinal axis. The upper guide pin 141 is mounted at a point on said outer tube so as to prevent further upward translation of the outer tube when said upper guide pin meets the upper end of the inner tube guide slot. The lower guide pin is mounted at a point on said outer tube so as to prevent further downward translation of the outer tube when said lower guide pin meets said lower end of said guide slot. Thus the length of the guide slot and the placement of the guide pins define the upper and lower limits of telescoping of the pivot pole. The guide pin positions, slot location and length are chosen so that the first end of the exterior nesting tube of the main body of the sealing apparatus is, upon full extension of the outer tube, a sufficient distance above the hydraulic clamping base 154 to clear both the base and the well pipe which will extend above the clamping base during operation.

Said inner tube of said pivot pole extends through the hydraulic clamping base 154 (see FIG. 9) and is rotatably mounted to said base. In the illustrated hydraulic embodiment the inner tube of the pivot pole is mounted to the upper 173 and lower 175 clamping base plates by means of mounting collars 179 and 181 which allow rotation but prevent the inner tube from moving vertically in relation to the mounting base. The lower clamping base plate is reinforced at the point of mounting to support the weight of the inner tube and the attachments thereto. It may be desirable to use roller bearings on the bearing surfaces between the vertical tube and the top and bottom clamping base plates to promote smooth rotation of the vertical member.

Fixedly attached to said inner tube at the point where the tube exits the lower end of said clamping base is the horizontal hydraulic cylinder mounting member 145 which extends horizontally from the lower end of said inner tube parallel to and in the same plane as said swing arm.

Figure 11:
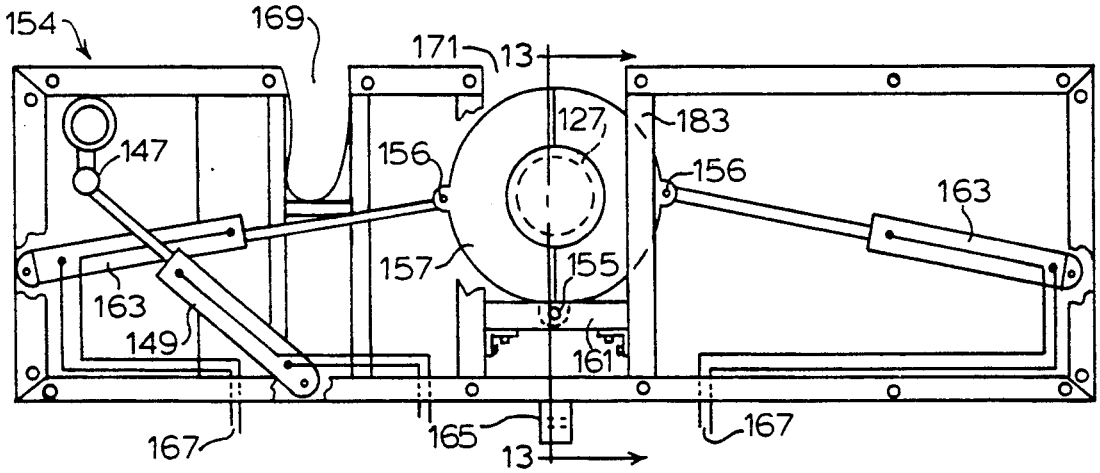
FIG. 11 is a partially cut away plan view of the hydraulic clamping base of the FIG. 9 embodiment showing the clamping jaws in closed position.

Fixedly attached to said inner tube within the clamping base is a pivot flange 147, as seen in FIG. 11 to which pivot flange is pivotally attached the first end of a pivot actuating bidirectional hydraulic cylinder 149. The second end of said cylinder is rotatably attached to a clamping base side bar frame member.

Approximately midway between said sealing apparatus and said outer tube of the pivot pole along said swing arm 133 is mounted the first end of the vertically translating bidirectional hydraulic cylinder 151 seen in FIG. 9. The vertically translating hydraulic cylinder extends vertically downward parallel to the longitudinal axes of the sealing apparatus and of the vertical member. The second end of said vertically translating hydraulic cylinder is mounted to the horizontal hydraulic cylinder mounting member 145.

The clamping base in the partially hydraulic embodiment of the invention is constructed of framing members and upper and lower enclosing plates substantially similar to those used in the mechanical embodiment. However, unlike the clamping base frame in the first described embodiment, the partially hydraulic embodiment contains two framed slots in the hydraulic clamping base. Both extend vertically from the lower plate to the upper plate and both are on the same side of the clamping base, the side which is closest to the well pipe as the apparatus approaches the well pipe. For purposes of this description, this side is referred to as the "back" of the device. The side away from the well pipe and toward the operator being referred to as the "front". The first slot 169 is the sealing apparatus positioning slot and is at least slightly wider in diameter than the outer cross-sectional diameter of the vertical hydraulic cylinder. Said first slot extends from the back side of the clamping base sufficiently into the clamping base to allow the vertical hydraulic cylinder which extends from the swing arm to the horizontal member to move without impediment into the position where the sealing apparatus is positioned directly over the longitudinal center line of the closed hinged clamping collar 157 seen in FIG. 11. The interior framing of the slot is positioned to reinforce the inner terminus of the slot so that the point of impact of the hydraulic cylinder with the inner terminus of the slot is reinforced sufficiently to effectively stop the inward motion of the cylinder.

The second slot in the back of the clamping base is the well pipe insertion slot 171. Said second slot is sufficiently greater in diameter than the outer diameter of the well pipe for which the device is designed to be used to allow the well pipe to fit easily within the slot. The slot may be flared toward the back side to facilitate insertion of the well pipe. Said second slot extends from the back of the clamping base into the interior of the clamping base to the point where the longitudinal axis of the well pipe at furthest insertion into said slot corresponds to the longitudinal axis of the closed clamping collar. As the inward progress of the well pipe through said second slot will be stopped by the hinge 155 of the opened clamping collar, it is not necessary that the interior end on the second slot be reinforced with framing as is the first slot if the hinged clamping collar is securely mounted to the clamping base frame as discussed below.

Figure 10:
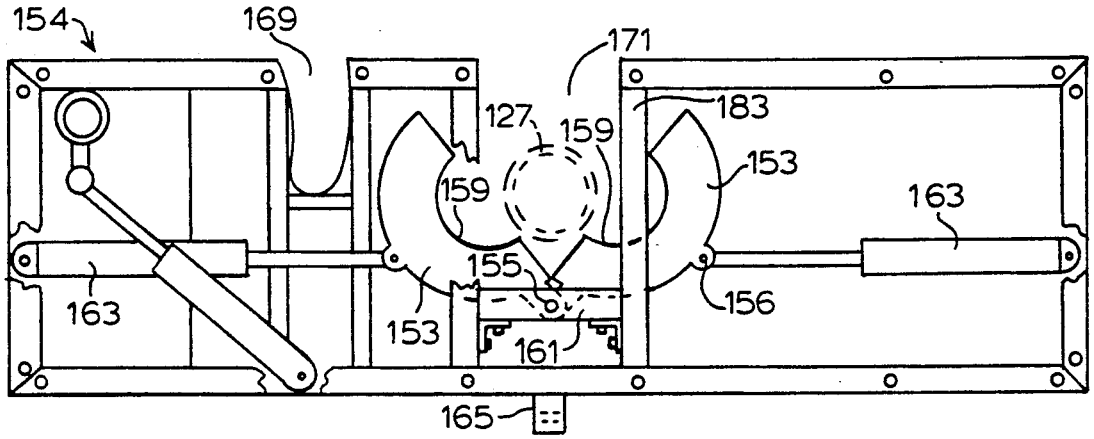
FIG. 10 is a partially cut away plan view of the hydraulic clamping base of the FIG. 9 embodiment showing the clamping jaws in open position.

Also disposed within said clamping base is said hinged clamping collar 157. In the illustrated embodiment, as seen in FIG. 10, said clamping collar has two jaws 153 with interior facing arcuate clamping faces 159 adapted to clamp around the circumference of a well head pipe of given diameter. Said clamping faces include clamping ridges similar to those of the clamping blades employed in the mechanical embodiment previously discussed. Said clamping collar jaws are substantially semicircular in cross section and are joined on one end by the hinge 155. Said clamping collar hinge is mounted to a transverse, internal frame member 161 which frame member is fixedly mounted to other frame elements of the clamping base.

Fixedly attached to the side of each said clamping collar member opposite the side containing said clamping face is a pivot mount 156 adapted to mount to the first end of a bidirectional clamping collar actuating hydraulic cylinder 163. The second end of said cylinder is rotatably attached to a clamping base frame member. Each said cylinder is capable of extending and retracting under hydraulic power and is capable of being actuated in coordination with the other so that both clamping collar members are extended or retracted in unison. In the fully retracted position illustrated in FIG. 10, said clamping collar jaws are apart and substantially removed from said second slot, allowing the passage of the well pipe into said second slot. In the fully extended position illustrated in FIG. 11, the clamping collar jaws meet and said collar is firmly clamped around any well pipe inserted into said second slot of said clamping base.

Attached to the front of the clamping base is at least one mounting bracket 165 adapted to allow the clamping base to be mounted to positioning means whereby said apparatus is positioned so that the well head pipe extends through said second slot. The bottom plate of the hydraulic clamping base 154 is also fitted with two skids 177, seen in FIGS. 9 and 13. Heat resistant hydraulic lines 167 also extend from said clamping base to a remote hydraulic pumping and controlling units. Said device can also be fitted with a heat shield (not shown) through which said hydraulic pipes may extend. Such hydraulic control units, heat shielding and positioning devices are old in the art and are not separately claimed.

The method of use of the partially hydraulic embodiment illustrated in FIGS. 9–14 differs from the method of use of the FIG. 1 embodiment in several respects. Although the function of the extension pipe and sealing sleeve are the same, the method of clamping the device to the well pipe, positioning the nesting tubes over the well pipe, and lowering the nesting tubes over the well pipe differs. The clamping base in the partially hydraulic embodiment contains a second slot 171 which allows the clamping base to be mounted on the well pipe from the side of the pipe rather than being lowered from the top. This is done by a boom or other suitable positioning device which is attached to the clamping base mounting bracket. The nesting tubes/extension pipe portion of the apparatus is pivotally mounted to the hydraulic clamping base. Thus, the nesting tubes/extension pipe can be pivoted out of the way of the well product flow while the clamping base is clamped to the well pipe. Of course the clamping jaws are in the open position, as illustrated in FIG. 10, during the positioning of the clamping base second slot around the well pipe. The clamping base should be placed around the pipe at a level which allows the well pipe to protrude from the top of the clamping base a sufficient distance to be inserted into the interior of the nesting pipes as earlier described. This mounting procedure has the advantage of allowing the apparatus to be secured to the pipe without the necessity of lowering the apparatus over the pressurized flow of well product.

Once the clamping base is in position with the well pipe in the second slot, the clamping jaw actuating hydraulic cylinders can be activated moving the clamping jaws from the open position to the closed position and securely clamping the well pipe to the clamping base. If the top of the well pipe is deformed, the clamping base can be first clamped to the well pipe near the end of the well pipe and the jaws closed to return the well pipe end to a cylindrical configuration. The jaws can then be opened and the clamping base repositioned further down the well pipe.

After the clamping jaws in the clamping base are securely closed around the well pipe, the pivot pole actuating hydraulic cylinder can be actuated, pivoting the telescoping pivot pole over the end of the well pipe. The telescoping pivot pole swing arm 133 and horizontal hydraulic cylinder mounting tube member 145, which are fixedly attached to the pivot pole, will swing as the pivot pole rotates, bringing the nesting pipes/extension pipe over the well pipe and bringing the vertically translating hydraulic cylinder to the interior end of the clamping base first slot 169. The base is designed so that the clockwise rotation of the pivot pole stops when the hydraulic cylinder reaches this point and so that the nesting pipes are centered over the clamped well pipe when the rotation stops.

Once the nesting pipes/extension pipe are in place over the top of the well pipe, the vertically translating hydraulic cylinder is actuated to lower the nesting pipes over the well pipe, inserting the well pipe end into the interior of the nesting pipes. The well pipe is inserted into the interior of the nesting pipes to the point where it is inside the interior nesting pipe, as in the earlier discussed FIG. 1 embodiment. At this point the sealing sleeve drive rods are actuated in the same fashion as in the FIG. 1 embodiment, sealing the well pipe to the nesting pipes/extension pipe. Once the sealing is complete, the extension pipe control valve is actuated, stopping the flow of well product. Once the flow is stopped the extension pipe cap swings back into place over the end of the extension pipe, extinguishing any remaining flame.

Figure 15:
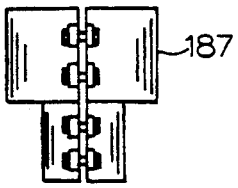
FIG. 15 is a front elevation view of the clamping sleeve which is used to clamp the sealing mechanism the well pipe in order to permit the removal of the FIG. 11 clamping base at the end of the sealing process.
Figure 16:
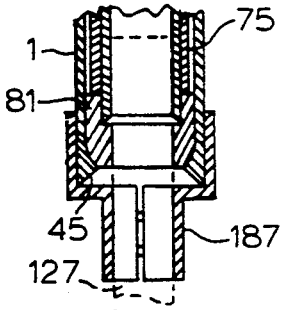
FIG. 16 is a front cross section view of the FIG. 15 clamping sleeve in position clamped around the exterior nesting pipe and the well pipe, also showing the well pipe, the exterior nesting pipe, the interior nesting pipe, the sealing material and the well pipe.
Figure 17:
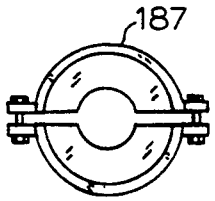
FIG. 17 is a plan view of the FIG. 15 clamping sleeve showing the two diameters of the sleeve sections, the top section with a greater diameter adapted to clamp around the exterior nesting pipe and the lower section with a lesser diameter adapted to clamp around the well pipe.
Figure 12:
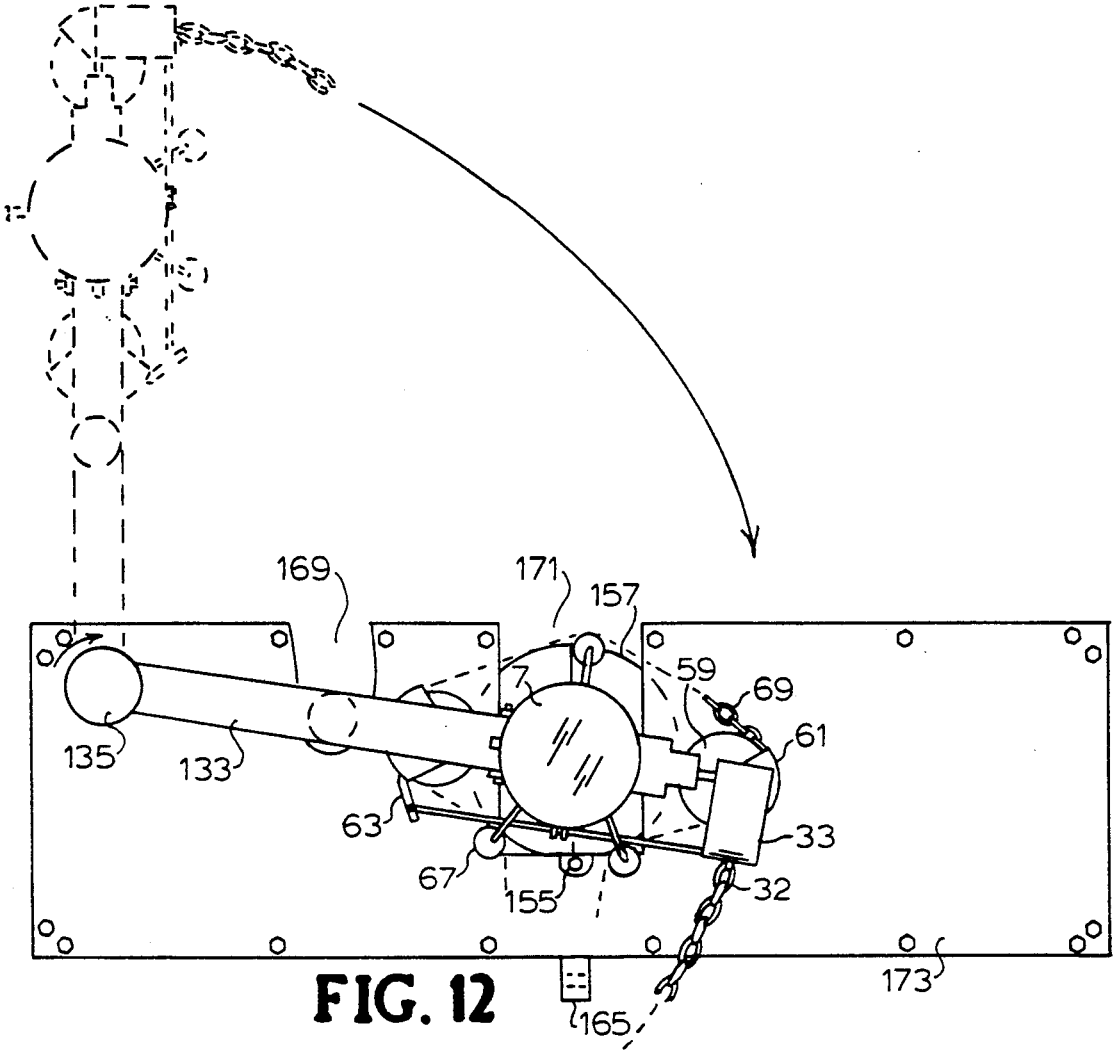
FIG. 12 is a plan view of the FIG. 9 embodiment showing the extension pipe/nesting pipes assembly both in place over the clamping jaws and rotated away from the clamping base.
Figure 13:
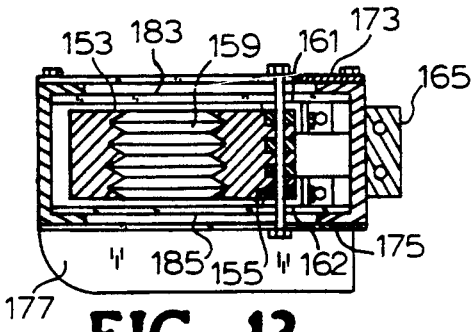
FIG. 13 is a cross section view on line 13—13 of FIG. 11 showing a hinged clamping jaw and its ridged gripping surface.
Figure 14:
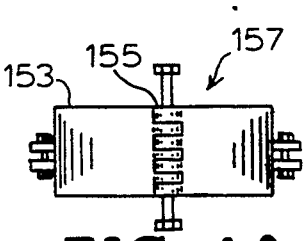
FIG. 14 is a front elevation view of the hinged clamping jaws in closed position.

The partially hydraulic embodiment illustrated in FIGS. 9-14 has an additional advantage due to the pivotal mounting of the clamping base to the nesting pipes/extension pipe. Once the sealing and capping of the well has been accomplished, the clamping base can be removed. In order to remove the clamping base, the swing arm 133 is detached from the swing arm mounting bracket and the clamping jaws are opened. The clamping base/pivot pole/swing arm assembly is then removed for reuse. A jacket clamp as illustrated in FIGS. 15-17 is then bolted in place around the junction of the well pipe and the exterior nesting pipe as illustrated in FIG. 17. As in the earlier discussed embodiment, the nesting pipes/sealing sleeve/extension pipe valve portion of the apparatus remains in place fixed to the well pipe. As in the FIG. 1 embodiment, the extension pipe can be replaced with a lead off pipe.

I claim:

1. An apparatus for controlling the flow of fluid from a well pipe comprising:

a. an extension pipe lowerably mounted as a part of the apparatus, and adapted to be connected to the upper end of a well pipe;

b: means attached to the extension pipe for controlling the flow of fluid through the extension pipe;

c. means for positioning the extension pipe over the well pipe;

d. means included in the apparatus for lowering the extension pipe over the well pipe;

e. means for securing the apparatus, with the extension pipe, to the well pipe; and f. means for sealing one end of the extension pipe with its controlling means to the well pipe.

2. An apparatus as recited in claim 1 wherein said extension pipe has a cap pivotally connected to the end opposite that which is adapted to be connected to the upper end of a well pipe, said cap being spring-loaded or counter-balanced in such a manner to remain in an open position when pressurized well product is exiting said opposite end of said extension pipe, but swing into a closed position when the pressure is substantially reduced.

3. An apparatus as recited in claim 1 wherein said controlling means is a valve.

4. An apparatus as recited in claim 1 wherein said sealing means comprises:

a. an exterior nesting pipe with a first end and a second end, said first end of said exterior nesting pipe being inwardly thickened, said inner edge of said first end of said exterior nesting pipe forming a circular constriction ridge with an inner diameter less than the inner diameter of the unthickened portions of said exterior pipe; and, b. an interior nesting pipe, concentrically disposed within said exterior nesting pipe so that the longitudinal axes of the interior and exterior nesting pipes coincide, having a first end and a second end, said second end being fused to said second end of said exterior pipe, c. said interior pipe further having an inner diameter slightly greater than the outer diameter of the well pipe on which said apparatus is designed to function and having an outer diameter sufficiently smaller than the inner diameter of the unthickened portion of said exterior nesting pipe forming an annular space between the interior wall of said exterior pipe and the exterior wall of the interior pipe and extending the length of the interior nesting pipe from its fused second end to its first end, said fused second ends of said nesting pipes being also fixedly connected to said extension pipe, d. said interior nesting pipe further being sufficiently shorter than said exterior pipe in length that said first end of said interior pipe terminates at a point inward of said constriction ridge of said exterior pipe creating a gap along the shared longitudinal axis of the nesting pipes between the first end of said interior pipe and the constriction ridge of said exterior pipe;

e. a sealing sleeve located in the annular space between said exterior nesting pipe and said interior nesting pipe and encircling said interior pipe, said sleeve being a pipe section of thickness sufficient to substantially fill said annular space but thin enough to be slidingly translatable within said annular space along the vertical axis of said nesting pipes, and said sealing sleeve having a first end and a second end which second end is closer to said fused second ends of said nesting pipes and which first end is closer to said first ends of said nesting pipes, said sealing sleeve further having a range of movement between a fully retracted position where said sealing sleeve is closest to said fused second ends of said nesting pipes and a fully extended position where said sealing sleeve is closest to said first ends of said nesting pipes;

f. a resilient, non-flammable, plastically deformable sealing material packed in that region of the annular space between said nesting pipes from a point several inches from said second end of said interior nesting pipes to the point on said exterior nesting pipe where said constriction ring is located, said sealing material packed in said region in sufficient quantity to completely fill said annular space in said region and said sealing material having the property that when met by compressive force urged upon it by the urging of said second end of said sealing ring against said sealing material, a portion of said sealing material will flow into the gap between said second ends of said nesting pipes and form a seal between a well pipe inserted into said apparatus and said interior pipe; and g. translating means whereby said sealing sleeve is translated along said vertical axis of said nesting pipes between said frilly retracted position and said fully extended position and in said fully extended position said first end of said sealing sleeve is urged against said sealing material.

5. An apparatus as recited in claim 4 wherein:

a. said exterior nesting pipe has a plurality of longitudinal slots through the pipe wall which slots are disposed substantially equidistantly around said pipe's circumference and which slots extend parallel to the longitudinal axis of said exterior nesting pipe;

b. said longitudinal slots extend from a point near said second end of said pipe; however, said slots do not extend into said region of said annular space in which said sealing material is packed;

c. said sealing sleeve has a plurality of flanges attached to its exterior surface near its second end which flanges each have a second end attached to the exterior surface of said sealing sleeve and a first end protruding through said exterior nesting pipe slot, said flanges being attached to a plurality of coordinated driving means adapted to translate said sealing sleeve along the longitudinal axis of said nesting pipes between its fully retracted position and its fully extended position.

6. An apparatus as recited in claim 4 wherein:

a. The surface of said thickened first end of said exterior nesting pipe is tapered inwardly so that the surface of said end forms an inverted cone section with the inner edge of the surface of said first end recessed inwardly toward the second end of said exterior pipe; and b. The surface of said first end of said interior nesting pipe, although not thickened, is also inwardly tapered in an inverted conical manner so that the taper angle of said second end of said interior pipe is substantially similar to said taper angle of said second end of said exterior pipe.

7. An apparatus as recited in claim 1 wherein said securing means is a clamping means attached to said extension pipe and adapted to clamp to the well pipe.

8. An apparatus as recited in claim 5 wherein said coordinated driving means comprises a plurality of threaded sealing sleeve drive rods each with first ends and second ends, said first ends each being fixedly attached to a sealing sleeve drive rod actuator through which coordinated rotational force is applied to said drive rods, said drive rods each passing through a threaded bore in a braced mounting platform which platform is attached to the outer surface of said exterior nesting pipe in a position where each said threaded bore is aligned with an exterior nesting pipe slot and the corresponding sealing sleeve flange protruding from said slot, to which protruding flange said second end is rotatably attached.

9. An apparatus as recited in claim 8 wherein said sealing sleeve drive rod actuators are of a type selected from the group consisting of sprockets and pulleys adapted to being driven by actuator drivers of a type selected from the group consisting of chains, cables, and belts, said drive rod actuators further arranged about the circumference of said exterior nesting pipe as to be capable of being driven by a single drive chain, cable or belt.

10. An apparatus as recited in claim 4 wherein said securing means is a clamping means which comprises:

a. a hollow, enclosed clamping base fixedly attached to said second end of said exterior nesting pipe which clamping base contains a substantially cylindrical central cavity the longitudinal axis of which cavity is aligned with the longitudinal axis of said extension pipe, said central cavity extending entirely through said clamping base and having a cross-sectional diameter substantially similar to the interior diameter of the unthickened portion of said exterior nesting pipe;

b. at least one clamping blade slidingly disposed interiorly within said clamping base with its clamping face oriented toward said central cavity, said clamping face having a plurality of clamping ridges fixedly attached to said clamping face and disposed parallel to each other along said clamping face and disposed perpendicular to the longitudinal axis of said nesting tubes, said clamping blade being capable of being disposed in a variety of positions from fully extended to fully retracted, said clamping blade in said fully retracted position not extending into said cavity, and said clamping blade in the fully extended position extending sufficiently into said cavity for the clamping face on said clamping blade to engage any well pipe present in said cavity; and, c. at least one pair of blade guides fixed to said clamping base upon which blade guides' guiding surfaces said clamping blade is slidingly mounted, each said blade guide being oriented within said clamping base so as to guide the respective clamping blade throughout its range of movement;

d. means for reversibly translating said clamping blade along said blade guides into said central cavity and urging the clamping face of said clamping blade against the exterior surface of said well pipe.

11. An apparatus as recited in claim 10 wherein said clamping blade translating and urging means is comprised of at least one threaded drive rod having a first end and a second end and extending through a threaded bore in said clamping base, said threaded bore being on the opposite side of said clamping blade from said central cavity, said first end of said drive rod being rotatably attached to said clamping blade at a point on said blade opposite said blade's clamping face, said drive rod extending through said threaded bore in such manner as said second end of said drive rod protrudes out of said clamping base; said second end of said drive rod further being attached to an actuator through which rotational force is applied to said drive rod.

12. An apparatus as recited in claim 10 wherein said clamping base further comprises a flared, tubular guide member aligned with said central cavity and attached to the clamping base at a point opposite the point of attachment of said clamping base to said second end of said exterior nesting pipe, said flared tubular member having its least interior diameter at the point of attachment and said least diameter being substantially similar to the cross-sectional diameter of said central cavity.

13. An apparatus as recited in claim 4 wherein said securing means is a clamping base connected to said sealing means by connecting means and further comprises;

a. a hollow clamping base with a top end and a bottom end and a near side and a far side, which top end is disposed toward said nesting tubes and which bottom end is disposed away from said nesting tubes and which near side is disposed toward the operator and which far side is disposed away from said operator, which clamping base contains a pipe slot greater in width than the diameter of the well pipe upon which said apparatus is designed to operate, said slot extending through said bottom end and said top end of said clamping base and extending into the clamping base from said far side a sufficient length to allow a well pipe to be slid into the slot from said far side, b. at least one hinged clamping jaw having a clamping face containing a plurality of parallel clamping ridges and being disposed within said clamping base with said clamping face oriented toward said pipe slot and the vertical axis of said hinge aligned parallel to the vertical axis of said slot and having a rotational range of movement from an open position in which said jaw does not extend into said slot to a fully closed position in which said clamping jaw extends sufficiently into said slot to engage the exterior surface of any well pipe inserted into said clamping base through said pipe slot;

c. means for urging said clamping jaw into said closed position;

d. means for retracting said clamping jaw back into said open position.

14. An apparatus as recited in claim 1 wherein said extension pipe controlling means, said positioning means, said lowering means, said securing means and said sealing means can be remotely actuated.

15. An apparatus as recited in claim 13 wherein said pipe slot is flared toward said far side of said clamping base so that the slot is wider at the opening of said pipe slot on the far side of said clamping base and narrower toward the interior of said clamping base.

16. An apparatus as recited in claim 13 further comprising guide rails which are attached to the far side of said clamping base, one guide rail on either side of and aligned with the edge of the opening of said pipe slot on the far side of said clamping base, said guide rails extending from said far side of said clamping base at an increasing distance from each other and in the same plane as said clamping jaw, which plane is substantially perpendicular to the longitudinal axis of said nesting pipes.

17. An apparatus as recited in claim 13 wherein said connecting means pivotally attaches said clamping base to said sealing means and said directing means comprises a first directing means for directing said clamping base slot in position around said well pipe and a second directing means for rotating said sealing means and extension tube in position above said well pipe.

18. An apparatus as recited in claim 17 wherein said clamping base and connecting means are removably attached to said extension pipe/nesting pipes assembly and further comprising a sleeve clamp which can be employed to clamp said exterior nesting pipe to said well pipe to allow for the disconnection of said clamping base and connecting mechanism from said extension pipe/nesting tubes assembly, allowing for the reuse of said clamping base and connecting means.

19. An apparatus as recited in claim 17 wherein said connecting means, second directing and lowering means comprise:

a. a vertical, telescoping pivot pole with a slotted inner tube and a pinned, hollow, outer tube, each tube having a first end and a second end, said second end of said inner tube extending through said bottom end of said clamping base for a short distance, said first end of said inner tube extending through said open second end of said outer tube into the interior of said outer tube, and said inner tube being pivotally mounted to said clamping base;

b. said outer tube at a point near its first end being fixedly attached to a horizontal swing arm extending perpendicularly from the longitudinal axis of said pivot pole which swing arm has a first end and a second end, said first end of said swing arm being removably attached to said extension tube, said second end of said swing arm being fixedly attached to said outer tube at a point near said outer tube's first end, c. said second end of said inner tube being fixedly attached to a hydraulic cylinder mounting member which extends perpendicularly from the longitudinal axis of said pivot pole in the same direction and in the same plane as said swing arm, d. said slotted inner tube of said pivot pole containing a longitudinal slot extending entirely through said tube and said pinned outer tube containing at least one pin mounted across the horizontal diameter of said outer tube and adapted to fit slidingly inside said inner tube slot, thus allowing vertical translation of said inner tube in relation to said outer tube but preventing independent rotational movement of said inner and outer tubes;

e. a bi-directional hydraulic cylinder adapted for high temperature operating conditions, with a first end and a second end, said first end being attached to said swing arm at a point between said swing arm's pivot pole attachment point and said swing arm's extension tube mounting point, and said second end being attached to said hydraulic cylinder mounting member at a point along said member where said hydraulic cylinder is substantially parallel to and in the same plane with said pivot pole and said extension tube;

f. said clamping base further containing an arcuate cylinder slot greater in width than the diameter of said hydraulic cylinder, said slot extending through said bottom end and said top end of said clamping base and extending into the clamping base from said far side so that, at the point of maximum rotation of said cylinder into said slot, said extension tube and said nesting pipes are centered directly over that portion of said pipe slot where said well pipe would be located after said hinged clamping jaw is fully closed on said well pipe.

20. A method for controlling the flow of fluid from a well comprising the steps of:

a. positioning a well pipe extension securing, sealing, and controlling apparatus to a position directly above the well pipe;

b. lowering said apparatus over the well pipe until such well pipe extends through said securing and sealing features of said apparatus;

c. securing said apparatus to said well pipe by actuating said securing features thereof;

d. sealing said apparatus to said well pipe by actuating said sealing features thereof; and e. controlling said flow by actuating said controlling features thereof.

21. A method as recited in claim 20 wherein said positioning, lowering, securing, sealing and controlling steps are remotely accomplished.

22. A method for controlling the flow of fluid from a well comprising:

a. positioning an open-ended pipe slot of a clamping base of a well pipe extension apparatus to a point where the open end of said pipe slot of said clamping base is adjacent to said well pipe;

b. further positioning said clamping base to a point where said well pipe is inserted in said pipe slot of said clamping base;

c. securing said clamping base to said well pipe by actuating a securing means within the clamping base;

d. rotating a pivotally mounted sealing means with the well pipe extension attached thereto, until the well pipe extension is centered over the secured well pipe;

e. lowering said pivotally mounted well pipe extension and sealing means until such well pipe extends into said sealing means of said well pipe extension;

f. sealing said well pipe extension to said well pipe by actuating said sealing means; and g. controlling said flow by actuating a controlling means located in the well pipe extension.

23. A method as recited in claim 2, wherein said directing, further directing, securing, rotating, lowering, sealing, and controlling steps are remotely accomplished.

24. A method for controlling the flow of fluid from a well comprising:

a. positioning an open-ended pipe slot of a clamping base of a well pipe extension apparatus to a point where the open end of said pipe slot of said clamping base is adjacent to said well pipe;

b. further positioning said clamping base to a point where said well pipe is inserted in said pipe slot of said clamping base;

c. securing said clamping base to said well pipe by actuating securing means within the clamping base;

d. rotating a pivotally mounted sealing means with the well pipe extension attached thereto, until the well pipe extension is centered over the secured well pipe;

e. lowering said pivotally mounted well pipe extension and sealing means until such well pipe extends into said sealing means of said well pipe extension;

f. sealing said well pipe extension to said well pipe by actuating said sealing means;

g. controlling said flow by actuating a controlling means located in the well pipe extension;

h. clamping a clamping sleeve to the sealing means and the well pipe to which the sealing means is sealed;

i. detaching said well pipe extension and sealing means away from the clamping base;

j. opening said securing means within the clamping base;

k. removing said clamping base from the well head.

* * * * *